US008384310B2

(12) United States Patent
Nerone

(10) Patent No.: US 8,384,310 B2
(45) Date of Patent: Feb. 26, 2013

(54) END-OF-LIFE CIRCUIT FOR FLUORESCENT LAMP BALLASTS

(75) Inventor: Louis Robert Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 229 days.

(21) Appl. No.: 12/901,035

(22) Filed: Oct. 8, 2010

(65) Prior Publication Data

US 2012/0086353 A1 Apr. 12, 2012

(51) Int. Cl.
*H05B 37/02* (2006.01)

(52) U.S. Cl. ..... 315/307; 315/224; 315/250

(58) Field of Classification Search ..... 315/209 R, 315/224, 250, 291, 297, 307, 308
See application file for complete search history.

(56) References Cited

U.S. PATENT DOCUMENTS

| | | | | |
|---|---|---|---|---|
| 4,471,268 | A | 9/1984 | Brown et al. | |
| 5,055,747 | A | 10/1991 | Johns | |
| 5,162,700 | A | 11/1992 | Soileau | |
| 5,650,694 | A | 7/1997 | Jayaraman et al. | |
| 5,808,422 | A | 9/1998 | Venkitasubrahmanian et al. | |
| 6,008,592 | A | 12/1999 | Ribarich | |
| 6,160,358 | A * | 12/2000 | Moisin | 315/291 |
| 6,400,095 | B1 | 6/2002 | Primisser et al. | |
| 6,741,043 | B2 | 5/2004 | Prasad | |
| 6,815,908 | B2 | 11/2004 | Glaser et al. | |
| 6,867,553 | B2 | 3/2005 | Nerone et al. | |
| 7,211,966 | B2 | 5/2007 | Green et al. | |
| 7,327,101 | B1 | 2/2008 | Chen et al. | |
| 7,436,124 | B2 | 10/2008 | Nerone et al. | |
| 2003/0168997 | A1 | 9/2003 | Nishimoto | |
| 2007/0029943 | A1 | 2/2007 | Erhardt et al. | |
| 2007/0296355 | A1 | 12/2007 | Hamamoto et al. | |
| 2009/0085493 | A1 | 4/2009 | Rudolph | |
| 2010/0001650 | A1 | 1/2010 | Hamana | |
| 2010/0013393 | A1 * | 1/2010 | Onishi et al. | 315/119 |
| 2010/0096995 | A1 | 4/2010 | Kishimoto | |
| 2010/0194302 | A1 * | 8/2010 | Nakada et al. | 315/224 |
| 2011/0163685 | A1 * | 7/2011 | Kumar et al. | 315/254 |

OTHER PUBLICATIONS

International Search Report, Dec. 23, 2011.
Written Opinion, Dec. 23, 2011.

* cited by examiner

*Primary Examiner* — Tung X Le
(74) *Attorney, Agent, or Firm* — Fay Sharpe LLP

(57) ABSTRACT

A ballast and method are presented for detecting end-of-life conditions of fluorescent lamps in which a ballast output is controlled according to a dimming input when a DC voltage or current of the lamp is in a predefined range or when the AC lamp current is below a predefined threshold, and the output is reduced to an EOL protection level when the lamp DC voltage or current is outside the predefined range and the AC lamp current is above the predefined threshold.

20 Claims, 3 Drawing Sheets

END-OF-LIFE CIRCUIT FOR FLUORESCENT LAMP BALLASTS

BACKGROUND OF THE DISCLOSURE

The filaments of fluoresce lamps are covered with emission mix to facilitate passage of electrons through the gas for production of light. Over time, the emission mix is sputtered off of the filaments in normal operation, particularly when the lamp is ignited with cold cathodes. When the emission mix becomes depleted, the lamp nears end-of-life ("EOL") and a higher voltage is required for the cathodes to emit electrons. The other filament in the lamp may not have an equally depleted emission mix, therefore, electrons from the good cathode will bombard the depleted filament with electrons, but the depleted filament will require a higher voltage to force the electrons back to the good filament. This higher voltage results in an increase in temperature which may overheat the lamp and in some cases crack the glass if the lamp is not replaced. Program-start ballast systems help extend the fluorescent lamp life by pre-heating the lamp filaments on startup before igniting the lamps, thereby mitigating emission mix depletion. Ballasts have been developed which detect when a fluorescent lamp nears the EOL condition, allowing controlled shutdown for replacement of the EOL lamp. Conventional EOL detection circuits and techniques may suffer from false triggering, particularly for dimming ballasts, whereby a need remains for improved end-of-life protection for fluorescent lamp ballasts.

SUMMARY OF THE DISCLOSURE

The present disclosure provides dimming ballasts and techniques for dimming ballast operation in which the ballast output is generated based on a dimming input with an end-of-life (EOL) protection circuit lowering the output to protect fluorescent lamps nearing and EOL condition, where the EOL protection circuit is selectively disabled for low operating lamp current levels.

A dimming ballast is provided, which includes an input rectifier producing an initial DC output, a DC-DC converter providing a second DC output, and an inverter that converts the second DC output to produce an AC output to power one or more fluorescent lamps. In certain embodiments, the inverter is a frequency-controlled self-oscillating inverter. The inverter output is controlled according to one or more inverter control signals or values provided by an inverter control system. The inverter control system receives an end-of-life (EOL) signal as well as a dimming signal or value that indicates a desired dimming level for the AC output. The inverter control system operates in a first mode (e.g., normal dimming mode) when the EOL signal is in a first state to provide the inverter control signal or value based at least partially on the dimming signal or value. When the EOL signal is in a second state, the inverter controller operates in a second mode (e.g., EOL protection) to provide the inverter control signal or value to control the output at a predetermined low level to prevent damage to a fluorescent lamp in an EOL condition.

The ballast includes an EOL detection circuit providing the EOL signal in the first state when the lamp DC voltage or current is in a predefined range or when the AC lamp current is less than a predefined AC current threshold value. When the lamp DC voltage or current is outside the predefined range and the AC lamp current is above the predefined AC current threshold value, the EOL detection circuit provides the EOL signal in the second state. In certain embodiments, the threshold value is greater than a glow point current value for the lamp. In certain embodiments, the threshold value is less than about 30% of a rated current for the lamp. In certain embodiments, the EOL detection circuit latches or maintains the EOL signal in the second state until a relamping detection signal is received, and the ballast includes a relamping circuit which detects lamp replacement and provides the relamping detection signal to the EOL detection circuit when a replacement of the lamp has been detected.

A method is provided for operating a dimming ballast to power one or more fluorescent lamps. The method includes providing an AC output to the fluorescent lamp, and controlling the AC output according to a dimming signal or value when a DC lamp voltage or current is in a predefined range or when an AC lamp current is less than a predefined AC current threshold value. The method also includes controlling the AC output at a predetermined low level to prevent damage to a fluorescent lamp in an EOL condition in a second mode when the DC lamp voltage or current is outside the predefined range and the AC lamp current is greater than the threshold value. In certain embodiments, the predefined AC current threshold value is greater than a glow point current value for the lamp. In certain embodiments, the threshold value is less than about 30% of a rated current for the lamp. Certain embodiments of the method include continuing to control the AC output at the predetermined low level until the lamp has been replaced.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
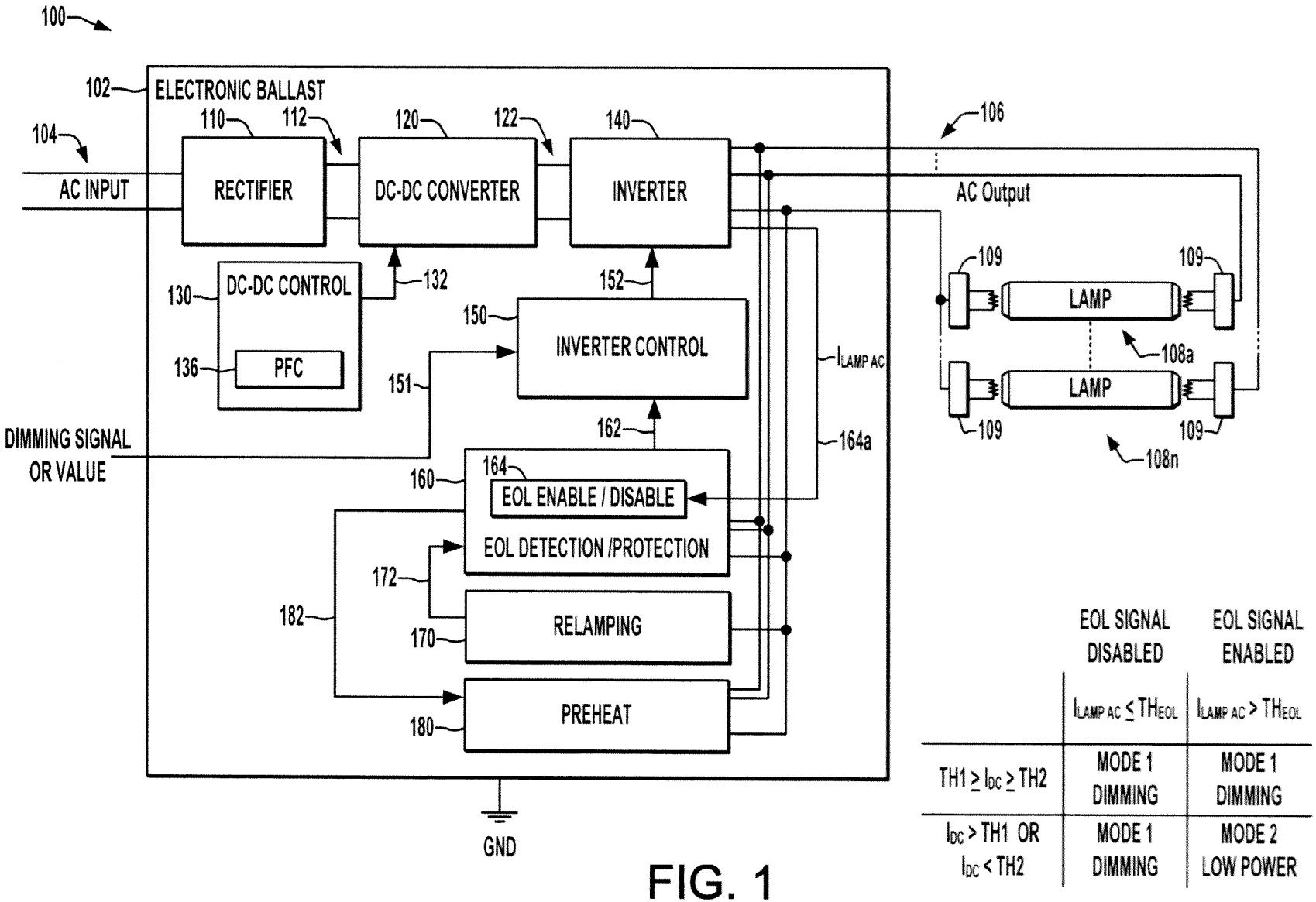
FIG. 1 illustrates an exemplary electronic ballast with a selective EOL detection and protection circuit.

Referring now to the drawings, like reference numerals are used to refer to like elements throughout and the various features are not necessarily drawn to scale. FIG. 1 illustrates an exemplary electronic ballast 102 with an input rectifier 110 that receives and rectifies single or multi-phase AC power from a ballast input 104. Any form of active or passive, full or half-wave rectifier 110 may be employed, such as a full bridge rectifier having four diodes (not shown) in one embodiment. The rectifier 110 has an output 112 providing a rectified DC voltage (a first or initial DC output) to a switching type DC-DC converter 120 in one embodiment, which includes various switching devices operated by one or more control signals 132 from a controller 130 to convert the rectified DC voltage into a converter DC output voltage at a converter output 122. The DC-DC converter controller 130 can be any suitable hardware, processor-executed software, firmware, configurable/programmable logic, or combinations thereof by which suitable switching control signals 132 may be generated for driving the switching devices of the DC-DC converter 120 to implement a desired conversion of the rectified initial DC to a second DC output 122. The converter control 130 in some embodiments includes a power factor control component 136 to control the power factor of the ballast 102, and the DC-DC converter 120 may include various capacitances and/or inductances.

The ballast 102 further provides an inverter 140 to convert the DC output voltage and current 122 to provide an AC output to drive one or more lamps 108 at an AC inverter output 106. The inverter 140 may be any suitable DC to AC converter, such as including one or more switching devices operated according to inverter control signals 152 from an inverter controller 150, and which may optionally include a transformer or other isolation components (not shown) to isolate the AC output from the input power. In certain embodiments, moreover, the inverter 140 may be a frequency-controlled self-oscillating inverter having an output 106 determined by an operating frequency, where the controller 150 provides one or more signals 152 to adjust or modify the operating frequency of the inverter 140 to thereby set the inverter output 106, where the control signaling 152 may provide for controlled adjustment of one or more resonant components (e.g., inductors) to affect a change in the inverter output in a controlled fashion. Examples of suitable frequency-controlled self-oscillating inverter configurations are shown in U.S. Pat. No. 7,436,124 to Nerone et al., the entirety of which is hereby incorporated by reference. The ballast 102 is operative to drive an integer number "n" lamps 108 via the inverter 140, where the illustrated inverter output 106 includes n positive lines for coupling to first ends of the driven lamps 108 and a common cathode connection coupled to the second lamp ends. Other combination series and parallel connected lamp loads 108 may be driven by the inverter 140 or the ballast 102 may be configured to drive a single lamp 108.

The inverter controller 150 includes dimming control circuitry operative according to a received dimming signal or value 151 (from any suitable source) to control the output of inverter 140 accordingly. The inverter control system 150 operates in one of two modes, with the mode being set by the state of a received end-of-life signal 162. In normal operation, referred to herein as a first mode when the end-of-life signal 162 is in a first state, the inverter control system 150 provides the inverter control signal(s) or value(s) 152 to the inverter 140 based in whole or in part on the dimming signal or value 151 for conventional dimmable lighting operation. When the EOL signal 162 is in a second state, the control system 150 is set to a different (second) mode in which the control signal(s) or value(s) 152 are provided so as to set the AC inverter output 106 to a predetermined low level to prevent damage to a fluorescent lamp 108 in an EOL condition.

The ballast 102 also includes an end-of-life (EOL) detection protection circuit 160 operatively coupled with the inverter output 106 to sense voltages and/or currents of the individual lamps 108 or groups thereof and which provides an inverter control input or EOL signal 162 to control the AC output 106 by setting the operational mode of the inverter controller 150. The EOL detection circuit 160 in certain embodiments includes an enable/disable circuit or logic 164 which overrides the EOL detection signal for certain low AC arc current conditions. As shown in FIG. 1, the ballast 102 may also include a relamping circuit 170 coupled with the common cathode connection of the inverter output 106 to sense a common cathode resistance of the lamps 108 to detect a user replacing one or more lamps 108, and which in certain embodiments selectively provides a latch reset signal 172 to the EOL circuit 160. Certain embodiments of the ballast 102, moreover, may include a preheat circuit 180 coupled with preheat or instant start circuits 109 at the inverter output 106 to selectively provide current to preheat the lamp cathodes according to a preheat control signal 182 from the EOL circuit 160.

Figure 2:
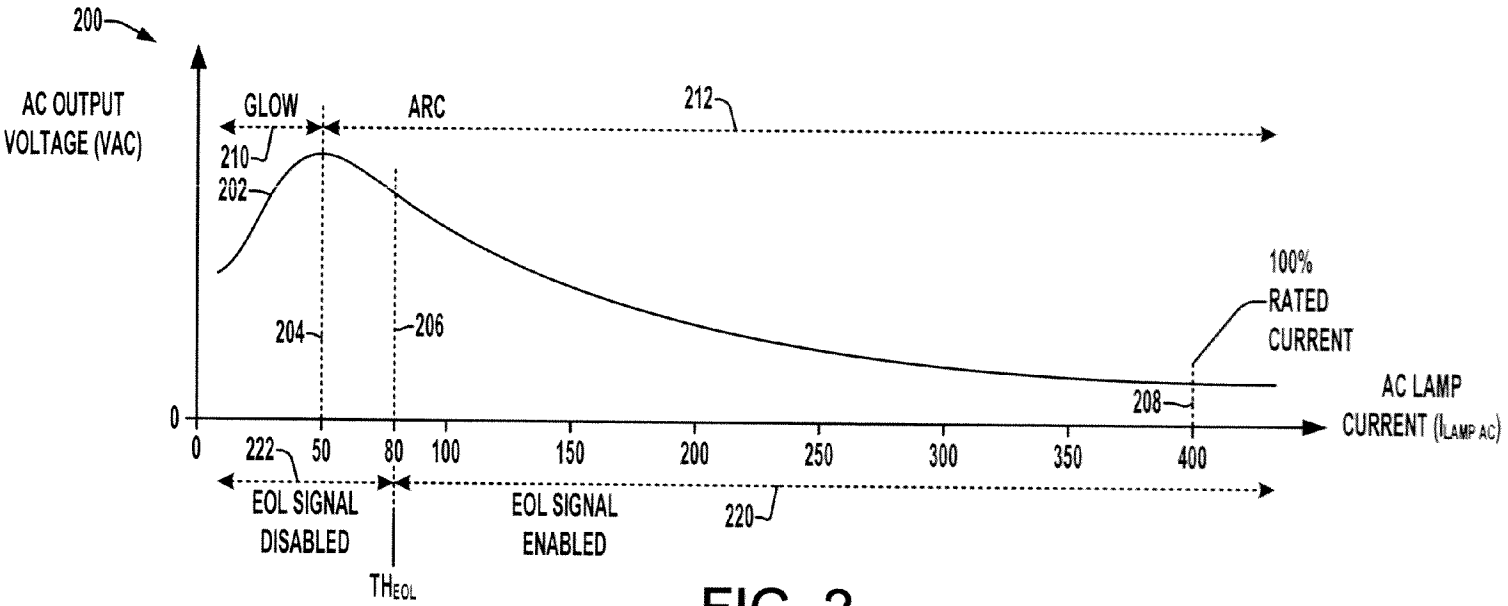
FIG. 2 is a graph illustrating voltage as a function of AC lamp current for a fluorescent lamp.
Figure 3B:
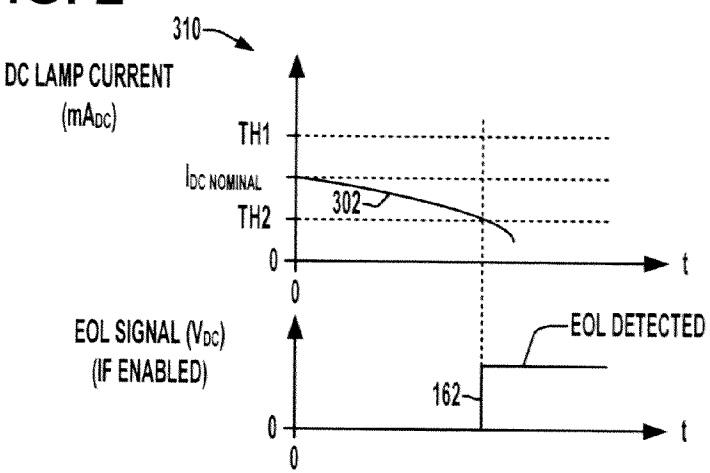
FIGS. 3A and 3B illustrate operation of the EOL detection circuit of FIG. 1 when the AC lamp current is above a threshold value.
Figure 3A:
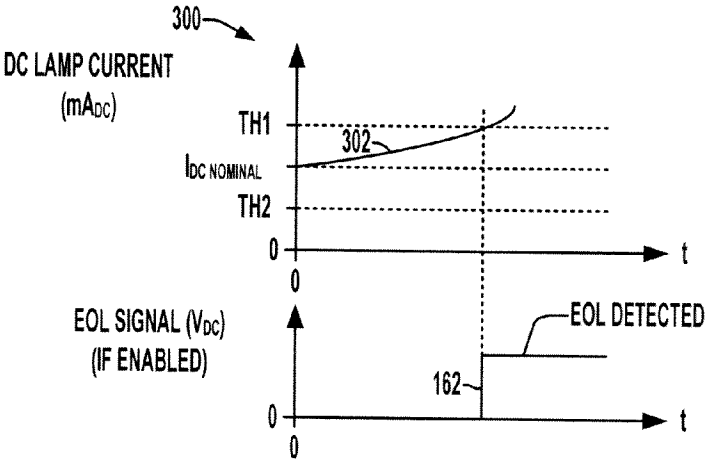

Referring to FIGS. 2, 3A, and 3B, FIG. 2 provides a graph 200 showing an AC output voltage curve 202 as a function of AC lamp current $I_{LAMP\ AC}$ for a fluorescent lamp or lamps (108). The curve 202 begins with rising voltage in a glow current range up to a glow current transition current value 204 (e.g., about 50 mA for an exemplary T5 lamp with a rated current value 208 of about 400 mA). The current range below this transition glow current value 204 defines a glow range 210, and above the transition 204 is an arc current range 212. The EOL enable/disable circuit 164 includes or is connected to circuitry to measure the AC lamp current 202 ($I_{LAMP\ AC}$) or receives a signal or value 164*a* (FIG. 1) representing the AC lamp current. The circuit 164 compares this AC lamp current value $I_{LAMP\ AC}$ with a predefined AC current threshold value $TH_{EOL}$ (206 in FIG. 2), and selectively disables the EOL detection for low arc current levels. In certain embodiments, the predefined AC current threshold value 206 $TH_{EOL}$ is greater than the glow point current value 204. In certain embodiments, moreover, the predefined AC current threshold value 206, $TH_{EOL}$ is less than about 30% of a rated current 208 for the at least one lamp 108, such as about 20% of the rated current in one example. For instance, a T5 lamp 108 having a rated current 208 of about 400 mA may have a glow current transition point 204 of about 50 mA.

In the example of FIG. 2, AC current threshold value 206 $TH_{EOL}$ is set to 80 mA which is above the glow current value 204 and is about 20% of the rated current level 208. In other embodiments, the threshold for disabling the EOL detection may be set at a suitable level according to the glow current transition point 204 and/or according to the rated current level 208 for a given lamp type, size, operating parameters, load connection configuration, and/or other particulars so as to selectively disable EOL detection for low arc current operating levels. As seen in FIG. 2, the predetermined AC current threshold value 206 $TH_{EOL}$ defines a first range 220 (EOL SIGNAL ENABLED) in which the EOL circuit 160 provides the EOL signal 162 in the first state (to place the inverter controller 150 in the first mode for normal dimming operation) if the lamp rectification is outside an expected normal operating level, and to otherwise provide the EOL signal 162 in the second state to place the inverter controller 150 in the second operating mode for EOL protection by lowering the inverter output 106 to a safe level. Conversely, for lower AC lamp current levels ($I_{LAMP\ AC}$ is less than the predetermined threshold 206 $TH_{EOL}$, the EOL signal 162 is always provided in the first state, so that the inverter output will be controlled according to the dimming signal or value 151 regardless of any measured or detected lamp rectification.

FIGS. 3A and 3B illustrate operation of the EOL detection circuit 160 of FIG. 1 when the AC lamp current is above the threshold value $TH_{EOL}$. The circuit 160 measures or is connected to circuitry suitable for measuring a DC aspect of at least one of the lamps 108, for example, a DC voltage across the lamp(s) 108 and/or a DC current $I_{DC}$ flowing through one or more of the lamps 108. Such measurement circuitry may be within the inverter 140 in certain implementations, or may be part of the EOL circuit 160 or in other circuitry of the ballast 102. Graphs 300 and 310 in FIGS. 3A and 3B respectively illustrate curves 302 showing the lamp DC current $I_{DC}$ in two exemplary situations when the AC lamp current $I_{LAMP\ AC}$ is at or above the threshold 206 $TH_{EOL}$ (EOL detection enabled). The EOL circuit 160 determines if the DC lamp current $I_{DC}$ is in a predefined range around a predetermined expected value $I_{DC\ NOMINAL}$. In the embodiment of FIGS. 3A and 3B, two DC current threshold values TH1 and TH2 are used, with TH1 above the nominal value and TH2 below the nominal value. The nominal DC current value and the thresholds TH1 and TH2 can be set according to a variety of factors, including known EOL characteristics for a given lamp 108 as well as known amounts of DC current provided to the lamp(s) 108, for instance, for anti-striation reasons and other circuit specifics.

In the situation of FIG. 3A, the $I_{DC}$ curve 302 at some point in time (dashed vertical line in the figure) rises above the upper threshold TH1. In this situation, provided that the AC lamp current $I_{LAMP\ AC}$ is at or above the AC current threshold 206 $TH_{EOL}$ (EOL detection enabled), the EOL circuit 162 provides the EOL signal 162 in the second state (high in FIG. 3A) to set the inverter controller 150 to the second mode for limiting the amount of power provided to the lamp, as the lamp 108 is deemed to be at or near the end-of-life due to emission mix depletion. FIG. 3B shows a different case in which the curve 302 falls below the lower threshold TH2, whereupon. The EOL signal 162 goes to the second state to provide EOL protection with the inverter controller 150 set to the second mode. Other embodiments are possible in which lamp DC voltage is used for detecting potential EOL conditions of one or more lamps 108.

As seen in FIGS. 2-3B, the EOL detection circuit 160 selectively provides the EOL signal 162 in the first state when the DC current $I_{DC}$ is in a predefined range $TH1 \geqq I_{DC} \geqq TH2$ (regardless of the AC current level). In addition, the circuit 160 provides the EOL signal 162 in the first state when the AC current $I_{LAMP\ AC}$ is below the threshold $TH_{EOL}$, (regardless of the Dc rectification level). Thus, the circuit 160 provides the EOL signal 162 in the second state only when the DC voltage or current $I_{DC}$ is outside the predefined range (e.g. $I_{DC}>TH1$ or $I_{DC}<TH2$) while the AC current $I_{LAMP\ AC}$ is at or above $TH_{EOL}$.

In certain embodiments, moreover, the EOL circuit 160 latches or maintains the EOL signal 162 in the second state until a relamping detection signal 172 is received from the relamping detection circuit 170. The relamping circuit 170 in these implementations detects replacement of one or more lamps 108 and provides the relamping detection signal 172 to the EOL detection circuit 160 when a lamp replacement has been detected.

The selective disabling of the EOL detection signal for lower arc current levels is useful for fluorescent lamps, particularly those having small diameters (e.g., 0.625 inches or less), which are sensitive to fault conditions, especially in architectural designs where the arc current during dimming operation is less than about 5% of the rated current. Absent this selective disabling, the EOL circuits may detect a fault condition and shut down the ballast to avoid overheating the lamp glass under conditions that may not warrant a fault. Disabling the EOL shut down at low arc current levels advantageously facilitates high sensitivity lamp fault detection to avoid over powering the electrodes of the lamp for normal operating levels, while mitigating the chances of false triggering in combination with safe operating levels (e.g., below $TH_{EOL}$). Thus, when the dimming level is determined to be currently below the predetermined safe level of arc current, the EOL circuit is effectively disabled.

Figure 4:
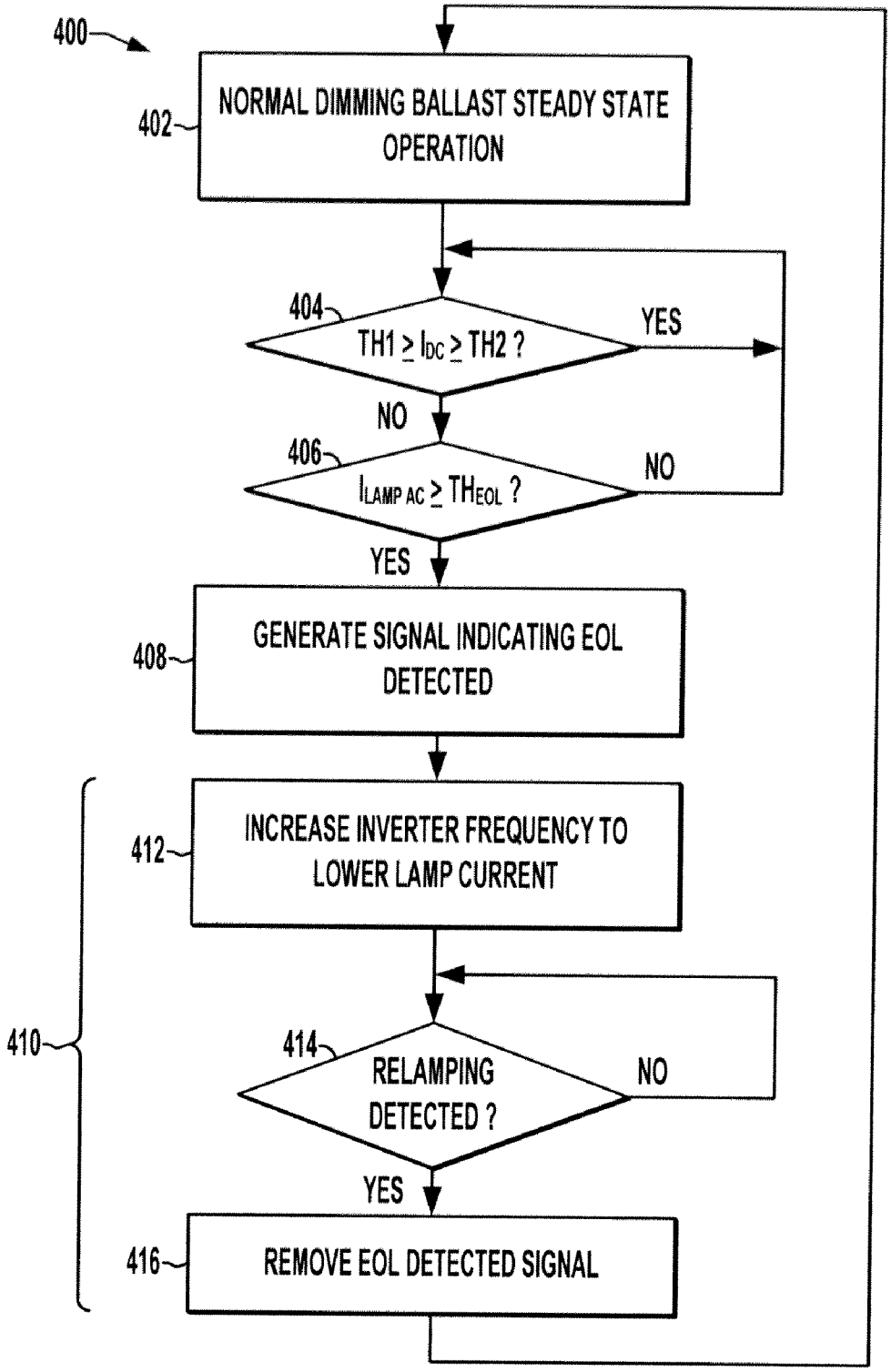
FIG. 4 is a flow diagram further illustrating operation of the EOL detection circuit.

Referring now to FIG. 4, a flow diagram 400 depicts exemplary operation of the EOL detection circuit 160 in the above described ballast 102. While the method 400 is illustrated and described below in the form of a series of acts or events, it will be appreciated that the various methods of the disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated method 400, moreover, may be implemented in hardware, processor-executed software, or combinations thereof, such as in the exemplary ballast 102 described above. Normal dimming ballast lighting operation is shown at 402 in FIG. 4, and a determination is made at 404 as to whether the lamp DC current $I_{DC}$ is within a predetermined range, outside of which the lamp is presumed to be at or near an end-of-life condition. If the determination at 404 is that the lamp is within the predetermined range ($TH1 \geqq I_{DC} \geqq TH2$, (YES at 404)), the normal operation continues. Otherwise (NO at 404), a further determination is made at 406 as to whether the AC lamp current is below a threshold (e.g., whether $I_{LAMP\ AC}<TH_{EOL}$). If not (NO at 406), the process returns to 404. Only if the $I_{DC}$ is outside the predefined range (e.g., $I_{DC}>TH1$ or $I_{DC}<TH2$) and the AC current $I_{LAMP\ AC} \geqq TH_{EOL}$ (YES at 406) does the process proceed to 408, where a signal (e.g., EOL detection signal 162) is generated in a state indicating that an end-of-life condition is detected.

Upon generation of the EOL detection signal at 408 (in the second state), the ballast 102 can take one or more remedial actions or precautions at 410. In the illustrated process 400, the frequency of the inverter 140 is increased at 412 in order to lower the lamp current $I_{LAMP\ AC}$. As previously mentioned, this can be accomplished at 412 by adjusting the timing of inverter switching control signals 152, or the signaling 152 can be used to adjust resonant circuit components (e.g., inductances) in self-oscillating type inverter circuits 140. This operation serves to protect the lamp(s) 108 from the possibility of damage once the end-of-life condition is near or has been reached by reducing the applied current to effectively limit the amount of power provided to the lamp(s) 108 (e.g., less than about 7.5 watts for a T5 lamp in one example). In certain embodiments, the EOL low power mode is maintained (lamp current continues to be controlled at the predetermined low level) until the at least one lamp 108 has been replaced. In certain embodiments, this is done by the EOL detection circuit 160 latching the EOL detection signal 162 in the second state until reset by way of a relamping detection signal 172. At 414 in FIG. 4, a determination is made as to whether such a relamping operation has been detected. If not (NO at 414), the low output operation is maintained. Once a relamping has been detected (YES at 414), the EOL detection signal is removed (e.g., rest to the first state) and a restart operation can proceed to light any replaced lamp(s) 108 and the process 400 returns to normal dimming operation at 402.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software, or combinations thereof, which performs the specified function of the described component (i.e., that is functionally equivalent), even though not structurally equivalent to the disclosed structure which performs the function in the illustrated implementations of the disclosure. Although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The following is claimed:

1. A dimming ballast for operating at least one fluorescent lamp, the ballast comprising:

an input rectifier operative to receive an AC input and to produce an initial DC output;

a DC-DC converter operatively coupled to the input rectifier to receive the initial DC output and to provide a second DC output;

an inverter operatively coupled to DC-DC converter to convert the second DC output to produce an AC output to power at least one fluorescent lamp;

an inverter control system operative to provide at least one inverter control signal or value to the inverter to control the AC output, the inverter control system receiving an end-of-life signal and a dimming signal or value indicating a desired dimming level for the AC output, the inverter control system operative in a first mode when the end-of-life signal is in a first state to provide the at least one inverter control signal or value based at least partially on the dimming signal or value and operative in a second mode when the end-of-life signal is in a second state to provide the at least one inverter control signal or value to control the output at a predetermined low level to prevent damage to a fluorescent lamp in an end-of-life condition; and an end-of-life detection circuit operative to selectively provide the end-of-life signal in the first state when a DC voltage or current of the at least one lamp is in a predefined range, to provide the end-of-life signal in the first state when an AC current of the at least one lamp is less than a predefined AC current threshold value, and to provide the end-of-life signal in the second state when the DC voltage or current of the at least one lamp is outside the predefined range and the AC current of the at least one lamp is greater than the predefined AC current threshold value.

2. The dimming ballast of claim 1, where the inverter is a frequency-controlled self-oscillating inverter.

3. The dimming ballast of claim 2, where the end-of-life detection circuit is operative to maintain the end-of-life signal in the second state until a relamping detection signal is received, the ballast further comprising a relamping circuit operative to detect replacement of the at least one lamp and to provide the relamping detection signal to the end-of-life detection circuit when a replacement of the at least one lamp has been detected.

4. The dimming ballast of claim 3, where the predefined AC current threshold value is greater than a glow point current value for the at least one lamp.

5. The dimming ballast of claim 4, where the predefined AC current threshold value is less than about 30% of a rated current for the at least one lamp.

6. The dimming ballast of claim 3, where the predefined AC current threshold value is less than about 30% of a rated current for the at least one lamp.

7. The dimming ballast of claim 2, where the predefined AC current threshold value is less than about 30% of a rated current for the at least one lamp.

8. The dimming ballast of claim 1, where the predefined AC current threshold value is greater than a glow point current value for the at least one lamp.

9. The dimming ballast of claim 8, where the predefined AC current threshold value is less than about 30% of a rated current for the at least one lamp.

10. The dimming ballast of claim 1, where the end-of-life detection circuit is operative to maintain the end-of-life signal in the second state until a relamping detection signal is received, the ballast further comprising a relamping circuit operative to detect replacement of the at least one lamp and to provide the relamping detection signal to the end-of-life detection circuit when a replacement of the at least one lamp has been detected.

11. The dimming ballast of claim 10, where the predefined AC current threshold value is greater than a glow point current value for the at least one lamp.

12. The dimming ballast of claim 11, where the predefined AC current threshold value is less than about 30% of a rated current for the at least one lamp.

13. The dimming ballast of claim 10, where the predefined AC current threshold value is less than about 30% of a rated current for the at least one lamp.

14. The dimming ballast of claim 1, where the predefined AC current threshold value is greater than a glow point current value for the at least one lamp.

15. The dimming ballast of claim 14, where the predefined AC current threshold value is less than about 30% of a rated current for the at least one lamp.

16. The dimming ballast of claim 1, where the predefined AC current threshold value is less than about 30% of a rated current for the at least one lamp.

17. A method for operating a dimming ballast to power at least one fluorescent lamp, the method comprising:

providing an AC output to at least one fluorescent lamp;

controlling the AC output according to a dimming signal or value when a DC voltage or current of the at least one lamp is in a predefined range or when an AC current of the at least one lamp is less than a predefined AC current threshold value; and controlling the AC output at a predetermined low level to prevent damage to a fluorescent lamp in an end-of-life condition in a second mode when the DC voltage or current of the at least one lamp is outside the predefined range and the AC current of the at least one lamp is greater than the predefined AC current threshold value.

18. The method of claim 17, comprising continuing to control the AC output at the predetermined low level until the at least one lamp has been replaced.

19. The method of claim 17, where the predefined AC current threshold value is greater than a glow point current value for the at least one lamp.

20. The method of claim 17, where the predefined AC current threshold value is less than about 30% of a rated current for the at least one lamp.

* * * * *